United States Patent [19]

Sakaki et al.

[11] Patent Number: 5,076,899

[45] Date of Patent: Dec. 31, 1991

[54] ALUMINUM ALLOY SUPPORT MATERIAL AND PROCESS FOR PRODUCING A SUPPORT FOR A LITHOGRAPHIC PRINTING PLATE

[75] Inventors: Hirokazu Sakaki; Kazushige Takizawa, both of Shizuoka; Shigenori Yamauchi, Aichi; Yuji Suzuki, Nagoya, all of Japan

[73] Assignees: Sumitomo light Metal Industries Co., Ltd., Tokyo; Fuji Photo Film Co., Ltd., Kanagawa, both of Japan

[21] Appl. No.: 520,898

[22] Filed: May 9, 1990

[30] Foreign Application Priority Data

May 9, 1989 [JP] Japan ..... 1-114080

[51] Int. Cl.[5] ..... C25F 3/04

[52] U.S. Cl. ..... 204/129.35; 204/129.4; 204/129.46; 204/129.75; 430/278

[58] Field of Search ..... 204/129.35, 129.4, 129.75, 204/129.46; 430/278

[56] References Cited

U.S. PATENT DOCUMENTS 4,189,320 2/1980 Hsieh ..... 430/278 X 4,435,230 3/1984 Fujikura ..... 430/278 X 4,729,939 3/1988 Nishikawa et al. ..... 430/278

4,822,715 4/1989 Shoji et al. ..... 430/278 X

*Primary Examiner*—Donald R. Valentine

*Attorney, Agent, or Firm*—Sughrue, Mion, Zinn, Macpeak & Seas

[57] ABSTRACT

An aluminum alloy support material for a lithographic printing plate which consists essentially, on a weight basis, of 0.5–2.0 % Mn, 0.05–1.0 % Si, 0.15–1.0 % Fe, 0–0.10 % Ti, and a balance of Al and inevitable impurities. The support material has a specific resistance satisfying the following inequality:

Specific resistance ($\mu\Omega$mm)$\leqq 14+16$[% Ti] as measured in liquid nitrogen at 77 K, and a particular size distribution of precipitates therein. The support is produced from an ingot of an aluminum alloy having the above composition by homogenizing, hot rolling, cold rolling, intermediate annealing, and finish cold rolling under specific conditions followed by electrochemical graining. The support has fine, uniform pits formed by electrochemical graining and improved strength and printability.

21 Claims, No Drawings

ALUMINUM ALLOY SUPPORT MATERIAL AND PROCESS FOR PRODUCING A SUPPORT FOR A LITHOGRAPHIC PRINTING PLATE

BACKGROUND OF THE INVENTION

1. Field of the Invention

This invention relates to an aluminum alloy support material for a lithographic printing plate and a process for producing a support for a lithographic printing plate. More particularly it is concerned with an aluminum alloy support material for a lithographic printing plate which is highly adaptable to electrochemical surface graining and a process for producing a support having improved strength with a reduced material cost.

2. Description of the Prior Art

Lithography has generally been carried out by using an aluminum alloy sheet as a support. The surface of the sheet is roughened by surface graining treatment in order to ensure good adhesion to a photosensitive layer which is formed on the sheet and improve water retention in non-image areas.

In the past, surface graining was performed mechanically, such as by ball graining, brush graining, or wire graining, but recently an electrochemical or electrolytic graining method has been frequently employed to roughen the surface of a support. In the electrochemcial method either an aqueous electrolytic solution containing hydrochloric acid as the sole or primary electrolyte (hereinafter referred to as a hydrochloric acid-based electrolytic solution) or an aqueous electrolytic solution containing nitric acid as the sole or primary electrolyte (hereinafter referred to as a nitric acid-based electrolytic solution) is used. The electrolytic graining method is capable of providing a printing plate having excellent processability and printability, and it is greatly adapted to continuous process using a coiled strip of an aluminum alloy.

The aluminum alloy conventionally used for producing a support for a lithographic printing plate includes those corresponding to JIS A1100 (Al purity: at least 99.0% by weight) or JIS A3003 (Al purity: 98.0–98.5% by weight) for mechanical graining, and those corresponding to JIS A1050 (Al purity: at least 99.5% by weight) for electrolytic graining, from which a uniform electrolytically grained surface can be obtained.

Although A1050-type aluminum alloys give good results by electrolytic graining, they have some drawbacks due to the high purity of aluminum. First, their strength is low and hence, if they are used in the form of a thin sheet, it is very difficult to handle the printing plate produced from the sheet. Second, the printing plate tends to soften during burning treatment to make handling of the plate even more difficult.

Printing speeds have been increasing as printing technology advances. Therefore, the stress applied to the printing plate which is mechanically secured to the opposite circumferential ends of the plate cylinder of a printing press is increased. If the support for the printing plate does not have sufficient strength, the secured ends of the plate will be deformed or broken, causing troubles such as printing shear or breakage of the printing plate, which often makes it impossible to continue the printing operation.

Accordingly, in order to assure that the plate has sufficient mechanical strength and dimensional stability, it is necessary to use a relatively thick aluminum alloy sheet as a support. This is a main cause of the high cost of lithographic printing plates.

Thus, aluminum alloys having a purity of at least 99.0% and particularly at least 99.5% by weight of Al such as JIS A1050-type aluminum alloys are excellent in adaptability to electrochemical graining, but their strength is not sufficient.

On the other hand, aluminum alloys containing less than 99.0% by weight aluminum and particularly JIS A3003-type aluminum alloys have high strength, but they give poor results (non-uniformly grained surface) when subjected to electrochemical graining. In addition, they have the disadvantage that tinting or staining in non-image areas tends to occur during printing.

Japanese Patent Application OPI (KOKAI) No. 60-63340 (1985) discloses that the uniformity of an electrochemically grained surface can be improved by controlling the number of eutectic intermetallics crystallized in an Al-Mn-Fe alloy per unit area of the sheet. However, even this technique cannot provide a uniformly grained surface by electrolysis.

If the grain formed on the surface of a support by electrochemical graining is not sufficiently uniform, the printing endurance limit or the maximum number of clear printings that can be obtained by a printing plate will decrease.

U.S. Pat. No. 4,686,083 discloses an aluminum alloy support for a lithographic printing plate which is suitable for electrochemical graining and which has improved fatigue resistance, heat softening resistance, and printability. The aluminum alloy disclosed therein comprises 0.05 to less than 0.8% Mn, at most 0.2% Si, at most 0.5% Fe, at most 0.1% Ti, and at most 0.02% B on a weight basis. A similar electrolytically grained aluminum alloy support which contains at least 0.2% Si is proposed in U.S. patent application Ser. No. 361,430.

Japanese Patent Application OPI (KOKAI) No. 52-39403 (1977) discloses an Al-Mn alloy support which contains 0.8–1.5% Mn, less than 1.5% impurities, and optionally less than 2.5% Mg on a weight basis and which needs no graining treatment.

Other aluminum alloy support materials are disclosed in U.S. Pat. Nos. 3,944,439; 4,427,500; 4,301,229; 4,435,230; 4,547,274; Japanese Patent Application OPI (KOKAI) No. 60-63347 (1985); Japanese Patent Publications (KOKOKU) Nos. 1-46577 (1989) and 1-47544 (1989).

SUMMARY OF THE INVENTION

It is an object of the present invention to provide a process for producing an aluminum alloy support for a lithographic printing plate which is free from the above-mentioned problems.

Another object of the present invention is to provide a process for producing an aluminum alloy support having an electrochemically grained surface with fine, uniform pits, which exhibits good printability and high strength, and which is suitable for use in high-speed printing.

A further object of the present invention is to provide an aluminum alloy support material which is well adapted to electrochemical graining to produce a support for a lithographic printing plate having improved properties.

These objects can be accomplished by an aluminum alloy support material for a lithographic printing plate in which the alloy consists essentially, on a weight basis, of 0.5–2.0% Mn, 0.05–1.0% Si, 0.15–1.0% Fe, 0–0.10%

Ti, and a balance of Al and inevitable impurities. The support material has a specific resistance satisfying the following inequality:

Specific resistance ($\mu\Omega$mm)$\leqq 14+16$[%Ti] as measured in liquid nitrogen at 77 K. The number of precipitates having a particle diameter (diameter of the equivalent circle) in the range of 0.05–0.2 $\mu$m comprises at least 60% of the total number of the precipitates in the material.

In another aspect, the present invention is a process for producing an aluminum alloy support for a lithographic printing plate, comprising, the steps of preparing an ingot from an aluminum alloy having the above-mentioned composition, sequentially subjecting the ingot to homogenizing at 400°–610° C., hot rolling at 400°–610° C., cold rolling, intermediate annealing at 350°–500° C. at a heat-up rate of 500° C./hr or lower, and finish cold rolling with a reduction in thickness of 30% or greater, and roughening the surface of the resulting aluminum alloy strip or sheet by electrochemical graining.

Other objects as well as the principle, nature, and advantages of the present invention will be apparent to those skilled in the art from the following detailed description. In the following description, all the percents are by weight unless otherwise indicated.

DETAILED DESCRIPTION OF THE INVENTION

Al-Mn alloys have been used in the prior art as a support material for lithographic printing plates due to their high strength. However, a sheet of such an alloy tends to form non-uniform coarse pits (macro-pits) when it is subjected to electrochemical graining, thereby adversely affecting the printability and printing endurance limit of a printing plate prepared therefrom.

The present inventors have found that the formation of non-uniform macro-pits on the electrochemically grained surface of an Al-Mn alloy support can be effectively prevented by reducing the amount of Mn dissolved in the matrix of the alloy as a solid solution with Al, i.e., by increasing the amount of Mn-containing precipitates in the alloy, and by controlling the particle diameters of the precipitates. For this purpose, Si and Fe are added to the Al-Mn alloy so as to precipitate a large proportion of Mn in the alloy in the form of fine precipitates of an Al-Mn-Si or Al-Mn-Fe-Si intermetallic compound.

Composition of Aluminum Alloy

Mn: 0.5–2.0%

Mn serves to increase the strength of the Al alloy. In the presence of Si and Fe, it forms fine precipitates of an Al-Mn-Si or Al-Mn-Fe-Si intermetallic compound, thereby causing fine, uniform pits to be formed by the subsequent electrochemical graining treatment. When the content of Mn is less than 0.5%, it does not provide the alloy with sufficient strength. With an Mn content in excess of 2.0%, a further increase in strength of the alloy cannot be attained and the proportion of large precipitates of eutectic intermetallic compounds formed in the alloy is increased, leading to the formation of coarse pits during electrochemical graining. The Mn content is preferably in the range of 0.7–1.5%.

Si: 0.05–1.0%

Si is dispersed in the alloy as fine precipitates of Al-Mn-Si or Al-Mn-Fe-Si intermetallic compounds, thereby reducing the amount of Mn dissolved in the matrix as a solid solution with Al, which increases the fineness and uniformity of the pits formed in the subsequent electrochemical graining.

This effect cannot be attained with an Si content of less than 0.05%. Addition of more than 1.0% Si tends to cause tinting or staining in non-image areas during printing. The Si content is preferably in the range of 0.1–0.5%. Fe: 0.15–1.0%

Fe also serves to reduce the amount of Mn dissolved in the matrix as a solid solution and to form fine, uniform pits on the electrochemically grained surface. This effect cannot be attained with an Fe content of less than 0.15%. Addition of more than 1.0% Fe tends to form coarse intermetallic compounds in the alloy and hence coarsens the pits formed by electrochemical graining. Furthermore, tinting or staining is often caused in non-image areas during printing. The Fe content is preferably in the range of 0.2–0.8%.

Ti: 0–0.10%

Ti may be optionally added to the alloy in order to form fine grains in a cast ingot of the alloy. When Ti is added, it is desirable that at least 0.01% Ti be added since addition of less than 0.01% Ti does not give an appreciable effect. The presence of more than 0.10% Ti makes the pits formed by electrochemical graining non-uniform. The Ti content is preferably in the range of 0–0.07%.

The aluminum alloy used in the present invention may further contain other alloying elements such as Cu and Mg as long as the addition thereof does not have an appreciable adverse effect on the desired properties of the alloy. The Cu content should be at most 0.05%, if it is added, since addition of more than 0.05% Cu interferes with electrochemical graining.

Specific Resistance

It has been found that uniform, fine pits are formed on the surface of an aluminum alloy sheet having the above-mentioned composition by electrochemical graining when the sheet has a specific resistance satisfying the following inequality:

Specific resistance ($\mu\Omega$mm)$\leqq 14+16$[%Ti] as measured in liquid nitrogen at 77 K. Thus, when the sheet contains no Ti, the specific resistance is at most 14 $\mu\Omega$mm. If the specific resistance is higher than the maximum value defined by the above inequality, non-uniform macro-pits will be formed on the electrochemically grained surface of the resulting support.

The above inequality was derived empirically, but can be explained as follows. As described above, fine, uniform pits are formed by electrochemical graining when the amount of Mn dissolved in the matrix as a solid solution is reduced. The amount of dissolved Mn has a direct correlation with the specific resistance of the alloy. Thus, the specific resistance of the alloy gives an indication of the amount of dissolved Mn therein. When the alloy has a specific resistance which is not greater than a certain limit, fine, uniform pits are formed by electrochemical graining. The specific resistance greatly depends on the Ti content of the alloy, so the maximum value for specific resistance varies with the Ti content as defined by the above inequality.

Size Distribution of Precipitates

When the number of precipitates of intermetallic compounds (Al-Mn-Si and Al-Mn-Fe-Si) having a particle diameter in the range of 0.05–0.2 $\mu$m is at least 60% and preferably at least 70% of the total number of the precipitates in the alloy material, fine, uniform pits are formed by electrochemical graining, which makes the resulting grained sheet suitable for use as a support for a lithographic printing plate.

If finer precipitates having a particle diameter of less than 0.05 μm or coarser precipitates having a particle diameter of over 0.2 μm are present in the alloy material in a greatly large proportion, excessively fine or coarse pits will be formed on the electrochemically grained surface, and the surface is no longer suitable for use as a support for a lithographic printing plate.

The distribution of particle diameters of precipitates in the alloy material is determined as follows.

A specimen of an aluminum alloy material is pretreated by heating to 400° C. at a heat-up rate of 50°-200° C./sec and maintaining at that temperature for 5 seconds, and thereafter it was allowed to cool. The purpose of this heat treatment is to cause recrystallization in the aluminum alloy material, thereby removing the deformed structure caused by the preceding processing, e.g., dislocations and subgrains and facilitating the observation of the precipitates on a transmission electron microscope. During the heat treatment, the precipitates do not undergo a significant change. Subsequently a transmission electron photomicrograph of the pretreated specimen is taken at a magnification of 10,000× and is examined by an image analyzing processor, e.g., LUZEX-500 manufactured by NIRECO CO., Ltd. to determine the distribution of particle diameters of the precipitates.

The diameter of each particle of the precipitates is measured in terms of the diameter of an equivalent circle, i.e., the diameter of the circle having the same area as the particle.

Based on the data of size distribution of precipitates thus obtained, the proportion of those precipitates having a particle diameter in the range of 0.05-0.2 μm is determined.

According to the process of the present invention, an aluminum alloy support for a lithographic printing plate is produced from an ingot of an aluminum alloy having the above-mentioned composition by processing under particular conditions to form an aluminum alloy strip or sheet and then performing electrochemical graining.

Processing Conditions

A cast ingot prepared from an aluminum alloy having the above-mentioned composition is sequentially subjected to homogenizing, hot rolling, cold rolling, intermediate annealing, and finish cold rolling under the conditions mentioned below.

Homogenizing

The aluminum alloy ingot is homogenized at a temperature in the range of 400°-610° C. and preferably in the range of 450°-600° C. in order to precipitate Mn, Fe, and Si which are dissolved in the matrix in the form of a supersaturated solid solution. The duration of homogenizing treatment depends on the size of the ingot, but usually it is in the range of 1-20 hours.

When the homogenizing temperature is lower than 400° C., intermetallic compounds of the alloying elements are not precipitated sufficiently and the pits formed by electrochemical graining become discrete and coarse. On the other hand, homogenizing at a temperature higher than 610° C. causes the precipitates to grow into coarse particles so that the proportion of coarse precipitates having a diameter over 0.2 μm is more than 40%, resulting in the formation of coarse pits on the electrochemically grained surface.

Hot Rolling

The homogenized ingot is hot rolled after it is heated at 400°-610° C. and preferably 450°-550° C.

At a temperature below 400° C., the reduction ratio per pass cannot be increased due to the high resistance to deformation of the ingot, resulting in an increase in the number of passes to attain the desired reduction ratio. This is disadvantageous from the viewpoint of economy.

Hot rolling at a temperature above 610° C. causes the precipitates in the alloy to grow into coarse particles and more than 40% of the precipitates may have a particle diameter of over 0.2 μm. Therefore, coarse pits will be formed during electrochemical graining.

After the ingot is homogenized, it may be cooled and then heated to perform hot rolling. Alternatively, the homogenized ingot is immediately subjected to hot rolling without cooling down. In the latter case, since the temperature range is the same between the homogenizing and the subsequent hot rolling steps, the heat treatment for homogenizing may be used to heat the ingot before hot rolling. Therefore, heating before hot rolling may be eliminated.

Cold Rolling

The hot-rolled strip is subjected to cold rolling to further reduce the thickness. The reduction ratio is usually 50-95%.

Intermediate Annealing

The cold rolled strip is then subjected to intermediate annealing at 350°-500° C. and preferably 350°-450° C. in order to cause recrystallization of the alloy material and control the amount and size distribution of the precipitates.

When the annealing temperature is lower than 350° C., recrystallization does not occur. Annealing at a temperature above 500° C. causes the precipitates to coarsen and dissolve again in the matrix as a solid solution. Therefore, the amount of dissolved alloying metals (which can be indicated by the specific resistance) and the size distribution of the precipitates in the resulting support material will be outside the appropriate ranges, and fine, uniform pits are not formed by electrochemical graining.

The intermediate annealing is performed by heating the strip at a rate of at most 500° C./hr and preferably at most 200° C./hr. When the rate of temperature rise is over 500° C./hr, sufficient precipitates are not formed in the course of heating, resulting in an increase in the amount of Mn which remains dissolved in the matrix as a solid solution. As a result, the pits formed by electrochemical graining become discrete and coarse.

Finish Cold Rolling

Following the intermediate annealing, the thickness of the aluminum alloy strip is finally reduced by finish cold rolling. The finish cold rolling causes the strip to have an increased strength so that the resulting support can be prevented from shearing by a gripper when it is rolled around a plate cylinder.

The finish cold rolling is performed with a reduction in thickness of at least 30% and preferably at least 50%. When the reduction is less than 30%, the strip does not have a sufficiently increased strength and the resulting support is not effectively prevented from shearing.

The thickness of the resulting strip is preferably in the range of 0.1–0.4 mm.

Surface Roughening

The aluminum alloy material in the form of a coiled strip or sheet (hereinafter collectively referred to as a sheet) obtained by the above processing is then subjected to surface roughening treatment to produce a desired support having a surface adapted to lithography.

According to the present invention, the surface roughening is performed by electrochemical (electrolytic) graining in which the aluminum alloy sheet is immersed in an hydrochloric acid- or nitric acid-based electrolytic solution while passing an alternating current.

Mechanical graining may be employed along with the electrochemical graining. In that case, the mechanical graining may be performed prior to the electrochemical graining. Suitable mechanical graining techniques include wire brush graining in which the surface of the aluminum alloy sheet is scratched by metallic wires, ball graining in which marble or graining balls and graining sand are used, and brush graining in which a nylon brush with pumice slurry and graining sand are used.

Prior to the electrolytic graining, the surface of the sheet to be treated is cleaned by a suitable cleaning treatment in order to remove the rolling oil adhering to the surface from rolling or the graining sand embedded in the depressions of the mechanically grained surface if it is pretreated by mechanical graining.

The removal of rolling oil can be performed by washing the surface with an organic solvent such as trichloroethylene (trichlene) or a solution of a surfactant. Another cleaning method which is effective for removal of both rolling oil and grinding sand comprises dipping the aluminum alloy sheet in an aqueous alkaline solution containing 1–30% of a compound such as sodium hydroxide, potassium hydroxide, sodium carbonate, or sodium silicate at a temperature of 20°–80° C. for 5–250 seconds for alkali etching, followed by dipping in an aqueous nitric or sulfuric acid solution (10–30%) at 20°–70° C. for 5–250 seconds for neutralization and removal of smut on the surface.

The cleaned surface of the aluminum alloy sheet is subjected to electrolytic graining with an alternating current, preferably in an electrolytic solution containing hydrochloric acid or nitric acid. The concentration of the electrolytic solution is preferably 0.01–3% and more preferably 0.05–2.5% for hydrochloric acid and preferably 0.2–5% and more preferably 0.5–3% for nitric acid.

Optional additives may be added to the electrolytic solution, as required. Examples of such additives include metal nitrates and chlorides, e.g., aluminum nitrate and aluminum chloride, monoamines, diamines, aldehydes, phosphoric acid, chromic acid, boric acid, and oxalic acid. These additives serve as a corrosion inhibitor or stabilizer or make the grained surface uniform.

The electrolytic solution is usually kept at a temperature of 10°–60° C. The alternating current used in the electrolytic graining can have any desired wave form which alternates between positive and negative voltages. For example, it can be a square wave, a trapezoidal wave, or a sine wave. Ordinary commercial single-phase or three-phase current may be used. The electrolytic graining is preferably performed with a current density of 5–100 A/dm$^2$ for 10–300 seconds.

The roughness of the electrolytically grained surface of the aluminum alloy sheet is controlled by the quantity of electricity in such a manner that the surface has a roughness in the range of 0.2–0.8 μm in Ra (center line average roughness). When the surface roughness exceeds 0.8 μm, the proportion of macro-pits formed on the grained surface is greatly increased compared with the case in which JIS A1050-type aluminum alloy is used. This is undesirable because macro-pits may cause tinting or staining on printed sheets. With a surface roughness of less than 0.2 μm, it is not possible to control the dampening solution on the printing plate and the dots on the shadow portions thereof tend to be linked, thereby degrading the quality of printing.

The aluminum alloy sheet which has been electrolytically grained in the above-mentioned manner can be used as a support for a lithographic printing plate. However, the grained sheet is usually subjected to post-treatment in a conventional manner before it is used as a support.

First, the grained sheet is immersed in a hot (40°–60° C.) sulfuric acid solution (10–50% conc.) or a dilute alkali (e.g., sodium hydroxide) solution in order to remove smut deposited on the surface thereof. When an alkali solution is used, the sheet is then immersed in an acid solution (nitric acid or sulfuric acid) for washing and neutralization.

The sheet is then subjected to anodizing in a conventional manner to coat the cleaned surface of the sheet with an anodized layer. Sulfuric acid is the most useful electrolytic solution for the anodizing, while phosphoric acid is also useful. The mixed acid method using sulfuric acid and phosphoric acid disclosed in Japanese Patent Application OPI (KOKAI) No. 55-28400(1980) can also be employed.

Anodizing in sulfuric acid is usually performed by passing a direct current, although an alternating current may be used. The sheet is anodized in a 5–30% sulfuric acid solution at a temperature of 20°–60° C. for 5–250 seconds to form an oxide layer having a weight of 1–10 g/m$^2$. A current density of 1–20 A/dm$^2$ is preferably employed.

When phosphoric acid is used as an electrolytic solution, the grained sheet is anodized in a 5–50% phosphoric acid solution at a temperature of 30°–60° C. for 10–300 seconds with a current density of 1–15 A/dm$^2$.

Following the anodizing treatment, further post-treatment may be applied to the aluminum alloy sheet, if desired. For example, the anodized sheet may be treated by immersing in an aqueous solution of polyvinylphosphonic acid as disclosed in British Patent No. 1,230,447 or in an aqueous solution of an alkali metal silicate as disclosed in U.S. Pat. No. 3,181,461.

After the post-treatment, the resulting support may be further coated, if necessary, with a subbing layer of a hydrophilic polymer, which is selected depending on the nature of the photosensitive layer applied thereon.

The grained surface of a support produced according to the process of the present invention is coated with a photosensitive layer to obtain a lithographic printing plate.

Examples of a photosensitive composition which can be used to form a photosensitive layer are as follows: (I) Photosensitive layer comprising an ester of a polyhydroxy polymer with o-naphthoquinonediazide-sulfonic acid or -sulfonyl chloride and a phenol-cresol novolak resin:

This type of a photosensitive layer becomes soluble in an alkaline solution upon exposure to light whereby exposed areas of the layer can be selectively removed with an alkaline developing solution.

Useful polyhydroxy polymers which are reacted with o-naphthoquinonediazide-sulfonic acid or -sulfonyl chloride to form an ester are phenolic resins having an average molecular weight of 1,000–7,000. A preferred example of such resins is a polycondensate of a phenol compound having at least two phenolic hydroxyl groups such as resorcinol or pyrogallol and an aldehyde such as formaldehyde or benzaldehyde. Other useful polyhydroxy polymers include phenol-formaldehyde resins, cresol-formaldehyde resins, p-tert-butylphenol-formaldehyde resins, and xylene-formaldehyde resins modified with phenol.

The photosensitive layer also contains a novolak resin. Preferred novolak resins are the phenol-m-cresol-formaldehyde novolak resin disclosed in Japanese Patent Application OPI (KOKAI) No. 55-57841(1980) and similar phenol novolak resins of relatively high molecular weight.

In order to make it possible to form a visible image upon imagewise exposure, the photosensitive layer contains a photosensitizer which is a compound capable of generating a Lewis acid when exposed to light. Useful photosensitizers include o-naphthoquinone-diazide-4-sulfonyl chloride, a salt of p-diazodiphenyl-amine with an inorganic anion, a trihalomethyl-oxadiazole compound, and a benzofuran ring-containing trihalomethyl-oxadiazole compound.

The photosensitive layer also contains a dye. Useful dyes are triphenylmethane-type dyes including Victoria Blue-BOH, Crystal Violet, and Oil Blue.

The photosensitive composition is applied to the grained surface of a support to a thickness sufficient to form a photosensitive layer of 0.5–3.0 g/m$^2$ as solids, i.e., on a dry basis. (II) Photosensitive layer comprising a diazo resin and a hydroxyl-containing, water-insoluble, oleophilic polymer:

Prior to application of a photosensitive layer, a support which has been anodized in the above-mentioned manner is preferably treated with a bath of an alkali metal silicate disclosed in U.S. Pat. No. 3,181,461. The treated surface is then coated with a photosensitive layer which comprises a salt of a diazo resin with $PF_6$ or $BF_4$, a salt of a diazo resin with an organic acid, and a hydroxyl-containing, water-insoluble, oleophilic polymer.

The photosensitive layer, when applied to a support produced by the present process, has improved storage stability and image visibility and can provide a lithographic printing plate which is stable even under severe conditions of high temperature and high humidity.

The diazo resin used in the photosensitive layer consists of a salt thereof with $PF_6$ or $BF_4$ and a salt thereof with an organic acid containing at least one phenolic hydroxyl or preferably sulfonic acid group. Useful sulfonic acid compounds to react with the diazo resin to form its organic acid salt include aromatic sulfonic acids such as triisopropyl-naphthalenesulfonic acid, 4,4'-biphenyldisulfonic acid, 5-sulfosalicylic acid, 2,5-dimethylbenzenesulfonic acid, 2-nitrobenzenesulfonic acid, 1-naphthol-5-sulfonic acid, and p-toluenesulfonic acid as well as hydroxyl-containing aromatic sulfonic acids such as 2-hydroxy-4-methoxy-benzophenone-5-sulfonic acid.

The hydroxyl-containing, water-insoluble, oleophilic polymer has a weight-average molecular weight of 5,000–500,000 and it includes the following:

(1) a copolymer of N-(4-hydroxyphenyl)acrylamide, N-(4-hydroxyphenyl)methacrylamide, N-(4-hydroxynaphthyl)methacrylamide, or the like with one or more other monomers;
(2) a copolymer of o-, m-, or p-hydroxystyrene with one or more other monomers; and
(3) a copolymer of o-, m-, or p-hydroxyphenyl methacrylate, or the like with one or more other monomers.

The monomer or monomers which are used in the preparation of these copolymers may be any monomers which are copolymerizable with the above-mentioned aromatic hydroxyl-containing monomers. Examples of such monomers are as follows:

(a) $\alpha,\beta$-unsaturated carboxylic acids such as acrylic acid, methacrylic acid, and maleic anhydride;
(b) alkyl acrylates such as methyl acrylate and ethyl acrylate;
(c) alkyl methacrylates such as methyl methacrylate and ethyl methacrylate;
(d) acrylamides and methacrylamides such as acrylamide, ethacrylamide, and methacrylamide;
(e) vinyl esters such as ethyl vinyl ether and hydroxyethyl vinyl ether;
(f) styrenes such as styrene and $\alpha$-methyl styrene;
(g) vinyl ketones such as methyl vinyl ketone;
(h) olefins such as ethylene, propylene, and isoprene; and
(i) N-vinylpyrrolidone, N-vinylcarbazole, acrylonitrile, and methacrylonitrile.

The photosensitive layer also contains an oil-soluble dye. Preferable dyes are Victoria Pure Blue-BOH, Crystal Violet, Victoria Blue, Methyl Violet, Oil Blue #603, and the like.

A coating composition used to form this type of photosensitive layer may further contain one or more additives which include fluorine-containing surfactants; nonionic surfactants; plasticizers such as dibutyl phthalate, polyethylene glycol, diethyl phthalate, and trioctyl phosphate; common stabilizers such as phosphonic acid, phosphorous acid, and various organic acids and the like. It is applied to the grained surface of a support with a coating weight of 0.5–2.5 g/m$^2$ on a dry basis to form the photosensitive layer.

This type of a photosensitive layer is changed from oleophilic to hydrophilic upon exposure to light. (III) Photosensitive layer of a photopolymerizable resin composition comprising a polymer which contains carboxylic acid residues or carboxylic acid anhydride residues, an addition-polymerizable unsaturated compound, and a photoinitiator:

When a photopolymerizable, photosensitive resin composition is applied, it is preferred that the surface of the support which has been grained in a hydrochloric acid-based electrolytic bath be anodized in phosphoric acid or a mixed acid of phosphoric acid and surfuric acid. The anodized support is then treated with an aqueous silicate solution and thereafter coated with a layer of a photopolymerizable, photosensitive composition which comprises a polymer containing carboxylic acid residues or carboxylic acid anhydride residues, an addition-polymerizable unsaturated compound, and a photoinitiator. This results in the preparation of a lithographic printing plate which is changed from water-soluble to water-insoluble upon exposure.

The photosensitive composition for electrophotography disclosed in Japanese Patent Application OPI (KOKAI) No. 60-107042(1985) may also be used in the preparation of this type of a lithographic printing plate.

The resulting lithographic printing plate has good storage stability. In addition, the exposed grained surface of the aluminum alloy support in the non-image areas is hardly stained by printing ink and has good hydrophilicity making it possible to rapidly remove ink therefrom. The surface also has good adhesion to the photosensitive layer.

Preferably the polymer which contains carboxylic acid residues or carboxylic acid anhydride residues for use in the preparation of the above-mentioned photopolymerizable composition has recurring structural units selected from the following (A) to (D):

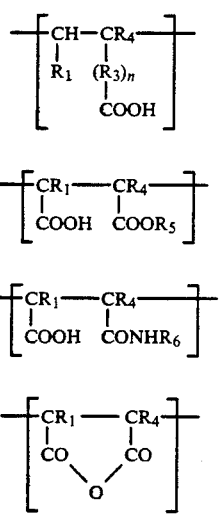

(A)

(B)

(C)

(D)

wherein $R_1$ and $R_4$ are each a hydrogen atom or an alkyl group, $R_3$ is phenylene or an alkylene group which may contain a hydroxyl group, $R_5$ is a hydrogen atom or a substituted or unsubstituted alkyl group, $R_6$ is a substituted or unsubstituted alkyl, allyl, aryl, or cycloalkyl group, and n is 0 or 1.

Specific examples of these structural units include: those derived from acrylic acid, methacrylic acid, crotonic acid, and vinylbenzoic acid for (A); those derived from maleic acid, maleic acid monohydroxyalkyl ester, and maleic acid monocyclohexyl ester for (B); those derived from maleic acid monoalkylamide and maleic acid monohydroxylalkyl amide for (C); and those derived from maleic anhydride and itaconic anhydride for (D). The average molecular weight of the polymer is usually in the range of 1,000–100,000.

The addition-polymerizable unsaturated compound is a monomer which has one or more ethylenically unsaturated double bonds and which undergoes addition polymerization in three dimensions when the photopolymerizable, photosensitive resin composition is irradiated with actinic radiation, thereby rendering the composition insoluble by three-dimensional crosslinking. Examples of such a monomer include unsaturated carboxylic acids, esters of an unsaturated carboxylic acid with an aliphatic polyhydroxyl compound, and esters of an unsaturated carboxylic acid with an aromatic polyhydroxyl compound.

The photoinitiator includes benzoin, a benzoin alkyl ether, benzophenone, anthraquinone, and Michler's ketone, which may be used alone or in combination.

The photosensitive composition is applied to the support with a coating weight of 1–3 g/m$^2$ on a dry basis to prepare a lithographic printing plate.

The following examples are given to further illustrate the present invention. It should be understood, however, that the present invention is not limited to the specific details set forth in the examples. Various modifications may be employed without departing from the concept of the present invention.

EXAMPLES

Part A

Each of aluminum alloys Nos. 1–11 having compositions shown in Table 1 was melted and cast. Each surface of the resulting casting was machined to give an ingot measuring 500 mm thick, 1000 mm wide, and 3500 mm long. The ingot was homogenized at 540° C. for 10 hours, hot rolled after being heated at 450° C., then cold rolled, heated to 380° C. at a heat-up rate of 50° C./hr to effect intermediate annealing, and finally cold rolled with a reduction in thickness of 85% to give a 0.30 mm-thick aluminum alloy strip.

TABLE 1

| No. | Al | Mn | Si | Fe | Ti | Remarks |
|---|---|---|---|---|---|---|
| 1 | Bal. | 0.64 | 0.19 | 0.31 | — | This |
| 2 | " | 1.0 | 0.30 | 0.20 | — | Invention |
| 3 | " | 1.6 | 0.79 | 0.83 | — | Alloy |
| 4 | " | 1.1 | 0.13 | 0.51 | 0.02 | |
| 5 | " | 1.0 | 0.39 | 0.48 | 0.08 | |
| 6 | " | 0.31 | 0.20 | 0.21 | — | Comparative |
| 7 | " | 2.5 | 0.33 | 0.52 | — | Alloy |
| 8 | " | 1.0 | 0.04 | 0.23 | — | |
| 9 | " | 0.9 | 1.2 | 0.39 | — | |
| 10 | " | 1.0 | 0.30 | 1.5 | — | |
| 11 | " | 1.3 | 0.50 | 0.50 | 0.22 | |

The resulting aluminum alloy strip was tested with respect to mechanical properties, specific resistance, and size distribution of precipitates in the alloy. The size distribution of precipitates was determined by analyzing photomicrographs at a magnification of 10,000× taken on a transmission electron microscope (TEM) by a LUZEX-500 image analyzer. The area subjected to image analysis was 200 $\mu m^2$ for each strip. The test results are shown in Table 2.

The 0.30 mm-thick aluminum alloy strip was subjected to chemical etching in an aqueous 10% sodium hydroxide solution at 50° C. for 2 minutes to clean its surface and was washed with a 20% nitric acid solution at 20° C. for neutralization. Subsequently electrolytic graining was performed on the cleaned strip in 1% nitric acid as an electrolytic solution at 50° C. by passing an alternating current with a current density of 30 A/dm$^2$ for 10 seconds.

The electrolytically grained strip was then immersed in a 15% sulfuric acid solution at 50° C. for 3 minutes to clean its surface and was anodized in an electrolytic solution based on 20% sulfuric acid at 30° C. so as to form an anodized layer with a weight of 3 g/m$^2$ on the grained surface.

A sheet cut from the anodized strip was used as a support and coated with a photosensitive coating composition to a thickness sufficient to form a photosensitive layer of 2.5 g/m$^2$ on a dry basis. The coating composition consisted of the following components in parts by weight:

1 part of an esterified product of naphthoquinone-(1,2)-diazide-(2)-5-sulfonyl chloride with a resorsinolbenzaldehyde resin;

3.5 parts of a copolycondensate resin derived from phenol, mixed m- and p-cresols, and formaldehyde;

0.03 parts of 2-trichloromethyl-5-[β-(2'-benzofuryl)-vinyl]-1,3,4-oxadiazole;

0.1 parts of Victoria Pure Blue-BOH (sold by Hodogaya Kagaku);

0.05 parts of an ester of a p-butylphenol-benzaldehyde novolak resin with o-naphthoquinonediazide-sulfonic acid; and 27 parts of methylcellosolve.

The resulting support having a photosensitive layer thereon was imagewise exposed to a 3 KW metal halide lamp at a distance of 1 meter for 50 seconds and then developed in an aqueous 4% sodium metasilicate solution at 25° C. for 45 seconds. After washing and drying, it was treated by gum coating to make a lithographic printing plate.

The printing plate was rolled up on a KOR offset press for testing with respect to tinting or staining in non-image areas and printing endurance limit. The appearance of the surface grain of the support was evaluated by observation on a scanning electron microscope.

The test results are also included in Table 2.

Examples 1–5 illustrate printing plate supports produced from an aluminum alloy material according to the present invention. Each support had a high tensile strength of at least 17.4 kgf/m$^2$ and a low specific resistance satisfying the foregoing inequality. The proportion of the precipitates having a particle diameter of 0.05–0.2 μm was at least 60% of all the precipitates and the surface grain was fine and uniform in all these examples. Regarding the printability, each support showed improved printing endurance limit and was capable of printing over 85,000 impressions with little tinting or staining in non-image areas.

Examples 6–11 illustrate comparative printing plate supports produced from an aluminum alloy material having a composition outside the range defined herein. The support of Example 6 had a low tensile strength due to the low Mn content, while that of Example 7 had non-uniform surface grain and resulted in a low printing endurance limit due to the high Mn content. Example 8 had a high specific resistance attributable to the low Si content, which resulted in a non-uniform surface grain and a low printing endurance limit. In Example 9, the high Si content caused tinting and staining in non-image areas to increase. Due to the high Fe content, the surface grain on the support of Example 10 was non-uniform, resulting in a low printing endurance limit and significant tinting and staining in non-image areas. Also in Example 11, the surface grain was non-uniform and the printing endurance limit was low because of the high Ti content.

Part B

The aluminum alloys Nos. 1–5 shown in Table 1 above were processed in the same manner as described in Part A so as to give surface-grained strips with the same thickness of 0.30 mm except that the processing conditions including the homogenizing temperature, the heating temperature before hot rolling, the conditions for intermediate annealing, the reduction ratio in finish cold rolling, and the graining method were changed as indicated in Table 3.

The graining methods employed were as follows:

Electrolytic Graining

Electrolytic graining was performed in the same manner as described in Part A, namely, by AC electrolysis in a 1% nitric acid electrolytic solution following chemical etching with 10% sodium hydroxide and washing with 20% nitric acid.

Mechanical Graining

The aluminum alloy strip was grained with a nylon brush while it was sprayed with water in which alumina sand was suspended as graining sand. Thereafter it was subjected to chemical etching in an aqueous 10% sodium hydroxide solution and washed in 20% nitric acid for neutralization.

Chemical Graining

Chemical graining was performed by chemical etching of the aluminum alloy strip in an aqueous 10% sodium hydroxide solution at 50° C. for 2 minutes followed by washing with 20% nitric acid for neutralization.

The resulting grained strips which served as supports were tested for mechanical properties, specific resistance, size distribution of precipitates, appearance of grain, printing endurance limit, and tinting and staining in non-image areas in the same manner as described in Part A.

The test results are also included in Table 3.

When the aluminum alloys were processed according to the process of the present invention, the resulting supports showed good results. On the contrary, if a certain condition was outside the range defined herein, the supports gave unsatisfactory results with respect to strength, specific resistance, size distribution of precipitates, appearance of grain, and/or printing endurance limit.

As discussed above, an aluminum alloy support produced in accordance with the present invention has enough tensile strength to effectively prevent breakage or shearing of the printing plate. Since it has an electrochemically grained surface having fine, uniform pits, it provides a lithographic printing plate exhibiting improved printing endurance limit and capable of preventing tinting and staining in non-image areas.

TABLE 2

| No. | Mechanical properties: Tensile strength (kgf/mm$^2$) | Mechanical properties: Proof stress (kgf/mm$^2$) | Mechanical properties: Elongation (%) | Specific resistance at 77 K (μΩmm) | Size distribution of precipitates (% in number of particles): Less than 0.05 μm | Size distribution of precipitates: 0.05–0.2 μm | Size distribution of precipitates: Over 0.2 μm | Appearance of surface grain* | Printing endurance limit (Number of impressions) | Tinting or stain in non-image areas |
|---|---|---|---|---|---|---|---|---|---|---|
| 1 | 17.4 | 16.6 | 7 | 10.4 | 6 | 90 | 4 | ◎ | 90,000 | Slight |
| 2 | 18.6 | 17.4 | 3 | 9.5 | 7 | 87 | 6 | ◎ | 85,000 | " |
| 3 | 19.5 | 18.9 | 3 | 7.5 | 7 | 85 | 8 | ◎ | 100,000 | " |
| 4 | 18.7 | 17.4 | 4 | 12.2 | 5 | 89 | 6 | ◎ | 95,000 | " |

TABLE 2-continued

| No. | Mechanical properties: Tensile strength (kgf/mm²) | Proof stress (kgf/mm²) | Elongation (%) | Specific resistance at 77 K (μΩmm) | Size distribution of precipitates (% in number of particles): Less than 0.05 μm | 0.05–0.2 μm | Over 0.2 μm | Appearance of surface grain* | Printing endurance limit (Number of impressions) | Tinting or stain in non-image areas |
|---|---|---|---|---|---|---|---|---|---|---|
| 5 | 19.0 | 17.9 | 3 | 14.2 | 6 | 90 | 4 | ◎ | 100,000 | " |
| 6 | 15.3 | 14.8 | 6 | 4.9 | 6 | 89 | 5 | ◎ | 80,000 | " |
| 7 | 20.1 | 19.3 | 3 | 12.1 | 5 | 86 | 9 | × | 50,000 | " |
| 8 | 18.3 | 17.1 | 4 | 14.3 | 7 | 85 | 8 | × | 43,000 | " |
| 9 | 18.8 | 18.0 | 3 | 5.9 | 5 | 90 | 5 | ◎ | 80,000 | Severe |
| 10 | 18.9 | 17.8 | 3 | 9.1 | 7 | 86 | 7 | × | 50,000 | " |
| 11 | 19.0 | 18.2 | 3 | 16.0 | 7 | 87 | 6 | × | 50,000 | Slight |

*Appearance of surface grain: ◎ : fine, uniform; ○: almost fine; ×: coarse, non-uniform with many macro-pits.

TABLE 3

| No. | Alloy | Processing conditions: Homogenizing temp. (°C.) | Hot rolling temp. (°C.) | Intermediate annealing: Heat-up rate (°C./hr) | Temp. (°C.) | Reduction in thickness in finish cold rolling (%) | Surface graining method* | Mechanical properties: Tensile strength (kgf/mm²) | Proof stress (kgf/mm²) | Elongation (%) |
|---|---|---|---|---|---|---|---|---|---|---|
| 1A | No. 1 | 430 | 480 | 50 | 360 | 75 | E | 17.1 | 15.9 | 6 |
| 1B | | 490 | 420 | " | 400 | 40 | E | 16.0 | 15.4 | 8 |
| 1C | | 560 | 520 | " | 370 | 60 | E | 16.9 | 15.7 | 7 |
| 1D | | 600 | 480 | 10 | 480 | 95 | E | 17.3 | 16.9 | 4 |
| 1E | | 480 | 580 | 360 | 400 | 80 | E | 17.0 | 15.9 | 6 |
| 1F | | — | 520 | 30 | 360 | " | E | 17.1 | 16.0 | 6 |
| 1G | | 350 | 390 | 30 | 380 | " | E | 17.1 | 15.8 | 6 |
| 1H | | 620 | 480 | 50 | " | " | E | 16.5 | 15.5 | 8 |
| 1I | | 500 | 620 | " | " | " | E | 16.4 | 15.3 | 8 |
| 1J | | 540 | 420 | 10,000 | 460 | " | E | 17.8 | 17.0 | 4 |
| 1K | | " | " | 50 | 200 | " | E | 21.5 | 21.3 | 1 |
| 1L | | " | " | " | 580 | " | E | 16.7 | 15.6 | 7 |
| 1M | | " | " | " | 360 | 15 | E | 13.7 | 12.6 | 10 |
| 1N | | 560 | 520 | " | 370 | 60 | M | 16.9 | 15.8 | 7 |
| 1O | | " | " | " | " | " | C | 16.8 | 15.8 | 6 |
| 2A | No. 2 | 500 | 500 | 50 | 360 | 75 | E | 18.4 | 17.3 | 4 |
| 2B | | 630 | " | " | " | " | E | 18.0 | 16.9 | 5 |
| 2C | | 500 | " | 100,000 | 480 | " | E | 18.6 | 17.4 | 4 |
| 2D | | " | " | 50 | 600 | " | E | 18.3 | 17.1 | 4 |
| 2E | | " | " | " | 360 | 20 | E | 14.7 | 13.0 | 9 |
| 2F | | " | " | " | " | 75 | M | 18.5 | 17.4 | 4 |
| 2G | | " | " | " | " | " | C | 18.4 | 17.5 | 4 |
| 3A | No. 3 | 580 | 460 | 30 | 400 | 65 | E | 19.0 | 18.4 | 5 |
| 3B | | 620 | " | " | " | " | E | 18.6 | 18.0 | 4 |
| 3C | | 580 | " | 200,000 | 460 | " | E | 19.2 | 18.6 | 4 |
| 3D | | " | " | 30 | 560 | " | E | 18.9 | 18.3 | 5 |
| 3E | | " | " | " | 400 | 10 | E | 14.0 | 12.9 | 10 |
| 3F | | " | " | " | " | 65 | M | 18.9 | 17.9 | 4 |
| 3G | | " | " | " | " | " | C | 18.8 | 18.0 | 4 |
| 4A | No. 4 | 480 | 450 | 100 | 380 | 80 | E | 18.6 | 17.5 | 4 |
| 4B | | 615 | " | " | " | " | E | 18.3 | 17.2 | 5 |
| 4C | | 480 | " | 100,000 | 480 | " | E | 18.9 | 17.9 | 3 |
| 4D | | " | " | 100 | 600 | " | E | 18.4 | 17.4 | 4 |
| 4E | | " | " | " | 380 | 20 | E | 13.9 | 12.2 | 9 |
| 4F | | " | " | " | " | 80 | M | 18.5 | 17.5 | 5 |
| 4G | | " | " | " | " | " | C | 18.6 | 17.4 | 4 |
| 5A | No. 5 | 520 | 420 | 20 | 380 | 80 | E | 18.9 | 17.9 | 3 |
| 5B | | 620 | " | " | " | " | E | 18.6 | 17.5 | 4 |
| 5C | | 520 | " | 10,000 | 460 | " | E | 19.2 | 18.2 | 3 |
| 5D | | " | " | 20 | 580 | " | E | 18.7 | 17.7 | 4 |
| 5E | | " | " | " | 380 | 10 | E | 13.8 | 12.3 | 9 |
| 5F | | " | " | " | " | 80 | M | 18.8 | 17.8 | 3 |
| 5G | | " | " | " | " | " | C | 18.9 | 17.8 | 3 |

| No. | Alloy | Specific resistance at 77 K (μΩmm) | Size distribution of precipitates (% in number of particles): Minus 0.05 μm | 0.05–0.2 μm | Over 0.2 μm | Appearance of surface grain** | Printing endurance limit (No. of impressions) | Tinting or staining in non-image area |
|---|---|---|---|---|---|---|---|---|
| 1A | No. 1 | 9.4 | 5 | 88 | 7 | ◎ | 90,000 | Slight |
| 1B | | 9.5 | 6 | 90 | 4 | ◎ | 85,000 | " |
| 1C | | 8.6 | 7 | 87 | 6 | ◎ | 90,000 | " |
| 1D | | 7.9 | 7 | 62 | 31 | ◎ | 90,000 | " |
| 1E | | 9.3 | 5 | 90 | 5 | ◎ | 95,000 | " |
| 1F | | 10.4 | 6 | 89 | 5 | ◎ | 85,000 | " |
| 1G | | 14.3 | 8 | 87 | 5 | × | 50,000 | " |
| 1H | | 11.3 | 2 | 57 | 41 | × | 50,000 | " |

TABLE 3-continued

| | | | | | | | | |
|---|---|---|---|---|---|---|---|---|
| 1I | | 11.3 | 2 | 58 | 40 | × | 50,000 | " |
| 1J | | 15.2 | 6 | 88 | 6 | × | 39,000 | " |
| 1K | | 9.3 | 6 | 89 | 5 | ◎ | 90,000 | " |
| 1L | | 15.1 | 6 | 88 | 6 | × | 45,000 | " |
| 1M | | 10.3 | 5 | 89 | 6 | ◎ | 85,000 | " |
| 1N | | 8.6 | 7 | 88 | 5 | × | 45,000 | " |
| 1O | | 8.5 | 6 | 88 | 6 | × | 40,000 | " |
| 2A | No. 2 | 9.5 | 6 | 88 | 6 | ◎ | 100,000 | " |
| 2B | | 11.3 | 2 | 55 | 43 | × | 50,000 | " |
| 2C | | 16.0 | 7 | 87 | 6 | × | 40,000 | " |
| 2D | | 14.2 | 5 | 88 | 7 | × | 50,000 | " |
| 2E | | 9.4 | 7 | 87 | 6 | ◎ | 90,000 | " |
| 2F | | 9.5 | 6 | 87 | 7 | × | 45,000 | " |
| 2G | | 9.4 | 5 | 89 | 6 | × | 40,000 | " |
| 3A | No. 3 | 7.6 | 7 | 76 | 17 | ◎ | 85,000 | Slight |
| 3B | | 9.5 | 3 | 56 | 41 | × | 50,000 | " |
| 3C | | 16.2 | 6 | 87 | 7 | × | 40,000 | " |
| 3D | | 15.0 | 7 | 86 | 7 | × | 45,000 | " |
| 3E | | 9.4 | 6 | 88 | 6 | ◎ | 90,000 | " |
| 3F | | 7.7 | 6 | 78 | 16 | × | 45,000 | " |
| 3G | | 7.6 | 7 | 78 | 15 | × | 42,000 | " |
| 4A | No. 4 | 13.2 | 7 | 88 | 5 | ◎ | 95,000 | " |
| 4B | | 13.2 | 2 | 55 | 43 | × | 50,000 | " |
| 4C | | 16.0 | 6 | 87 | 7 | × | 45,000 | " |
| 4D | | 15.1 | 7 | 86 | 7 | × | 50,000 | " |
| 4E | | 12.1 | 6 | 88 | 6 | ◎ | 90,000 | " |
| 4F | | 13.1 | 6 | 89 | 5 | × | 45,000 | " |
| 4G | | 13.2 | 7 | 89 | 4 | × | 40,000 | " |
| 5A | No. 5 | 14.0 | 6 | 89 | 5 | ◎ | 95,000 | " |
| 5B | | 15.0 | 2 | 56 | 42 | × | 45,000 | " |
| 5C | | 18.5 | 5 | 90 | 5 | × | 40,000 | " |
| 5D | | 17.0 | 7 | 89 | 4 | × | 50,000 | " |
| 5E | | 14.1 | 6 | 88 | 6 | ◎ | 90,000 | " |
| 5F | | 14.1 | 6 | 90 | 4 | × | 50,000 | " |
| 5G | | 13.9 | 7 | 89 | 4 | × | 43,000 | " |

*E: Electrochemical graining, M: Mechanical graining, C: Chemical graining;
**Appearance of surface grain: ◎ : fine, uniform; ○: almost fine; ×: coarse, non-uniform with many macro-pits.

What is claimed is:

1. A process for producing an aluminum alloy support for a lithographic printing plate, comprising the steps of:

preparing an ingot from an aluminum alloy which consists essentially, on a weight basis, of 0.5–2.0% Mn, 0.05–1.0% Si, 0.15–1.0% Fe, 0–0.10% Ti, and a balance of Al and inevitable impurities;

subjecting the ingot sequentially to homogenizing at 400°–610° C., hot rolling after heating at 400°–610° C., cold rolling, intermediate annealing at 350°–500° C. with heating at a rate of at most 500° C./hr, and finish cold rolling with a reduction in thickness of 30% or greater; and roughening the surface of the resulting aluminum alloy strip or sheet by electrochemical graining.

2. The process as claimed in claim 1 wherein the alloy contains no titanium.

3. The process as claimed in claim 1 wherein the alloy contains 0.01–0.10% Ti.

4. The process as claimed in claim 1 wherein the alloy contains 0.7–1.5% Mn.

5. The process as claimed in claim 1 wherein the alloy contains 0.1–0.5% Si.

6. The process as claimed in claim 1 wherein the alloy contains 0.2–0.8% Fe.

7. The process as claimed in claim 1 wherein the homogenizing is performed at 450°–600° C.

8. The process as claimed in claim 1 wherein the hot rolling is performed after heating at 450°–550° C.

9. The process as claimed in claim 1 wherein the intermediate annealing is performed at 350°–450° C.

10. The process as claimed in claim 1 wherein the intermediate annealing is performed with heating at a rate of at most 200° C./hr.

11. The process as claimed in claim 1 wherein the final cold rolling is performed with a reduction in thickness of at least 50%.

12. The process as claimed in claim 1 wherein the electrochemical graining is performed by AC electrolysis in a hydrochloric or nitric acid-based electrolytic solution.

13. The process as claimed in claim 12 wherein the electrolytic solution is a hydrochloric acid solution in a concentration of 0.01–3% by weight.

14. The process as claimed in claim 13 wherein the hydrochloric acid solution has a concentration of 0.05–2.5% by weight.

15. The process as claimed in claim 12 wherein the electrolytic solution is a nitric acid solution in a concentration of 0.2–5% by weight.

16. The process as claimed in claim 15 wherein the nitric acid solution has a concentration of 0.5–3% by weight.

17. The process as claimed in claim 1 wherein the surface roughening is performed by mechanical graining followed by electrochemical graining.

18. A lithographic printing plate which comprises an aluminum alloy support having a photosensitive layer on the surface thereof, said support being produced by the process comprising the steps of:

preparing an ingot from an aluminum alloy which consists essentially, on a weight basis, of 0.5–2.0% Mn, 0.05–1.0% Si, 0.15–1.0% Fe, 0–0.10% Ti, and a balance of Al and inevitable impurities;

subjecting the ingot sequentially to homogenizing at 400°–610° C., hot rolling after heating at 400°–610° C., cold rolling, intermediate annealing at 350°–500° C. with heating at a rate of at most 500°

C./hr, and finish cold rolling with a reduction in thickness of 30% or greater; and roughening the surface of the resulting aluminum alloy strip or sheet by electrochemical graining.

19. The lithographic printing plate as claimed in claim 18 wherein the photosensitive layer comprises an ester of a polyhydroxy polymer with o-naphthoquinonediazide-sulfonic acid or -sulfonyl chloride and a phenol-cresol novolak resin.

20. The lithographic printing plate as claimed in claim 18 wherein the photosensitive layer comprises a diazo resin and a hydroxyl-containing, water-insoluble, oleophilic polymer.

21. The lithographic printing plate as claimed in claim 18 wherein the photosensitive layer is formed from a photopolymerizable, photosensitive composition which comprises a polymer containing carboxylic acid residues or carboxylic anhydride residues, an addition-polymerizable unsaturated compound, and a photoinitiator.

* * * * *